US006414639B1

(12) United States Patent
Iio

(10) Patent No.: US 6,414,639 B1
(45) Date of Patent: Jul. 2, 2002

(54) RESONANCE DEVICE, AND OSCILLATOR, FILTER, DUPLEXER AND COMMUNICATION DEVICE INCORPORATING SAME

(75) Inventor: Kenichi Iio, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/436,820

(22) Filed: Nov. 9, 1999

(30) Foreign Application Priority Data

Nov. 9, 1998 (JP) ..... 10-317525

(51) Int. Cl.[7] ..... H01Q 1/24
(52) U.S. Cl. ..... 343/702; 333/126; 333/208
(58) Field of Search ..... 343/702; 455/73; 333/126, 134, 101, 208

(56) References Cited

U.S. PATENT DOCUMENTS

| | | | | |
|---|---|---|---|---|
| 3,840,828 A | | 10/1974 | Linn et al. | 333/73 |
| 5,387,886 A | * | 2/1995 | Takalo et al. | 333/101 |
| 5,604,470 A | * | 2/1997 | Atokawa | 333/126 |
| 5,898,909 A | * | 4/1999 | Yoshihara et al. | 455/73 |
| 5,986,521 A | * | 11/1999 | Tada et al. | 333/134 |

FOREIGN PATENT DOCUMENTS

| | | |
|---|---|---|
| JP | 56-75704 | 6/1981 |
| JP | 56-75705 | 6/1981 |

OTHER PUBLICATIONS

"Microwave planar passive circuits and filters," J. Helszajn, John Wiley & Sons, 1994, pp. 90–93.
Patents Abstracts of Japan, vol. 1998,no 12, Oct. 31, 1998 & JP 110 200042 A, Jul. 31, 1998, abstract.
Patents Abstracts of Japan, vol. 5, No. 141, Sep. 5, 1981.
Patent Abstracts of Japan, vol. 5, No. 141, Sep. 5, 1981.
Hosoya K et al.: "Systematic Evaluation and Analysis for 60–GHZ Dielectric Resonators Coupled to a Microstrip Line on a GAAS Substrate" IEEE Transactions on Microwave Theory and Techniques, US, IEEE Inc., New York, vol. 46, No. 4, Apr. 1998, p. 352–358, p. 354, left–hand col., line 34–line 42; figure 4.
European Search Report dated Jan. 27, 2000.
European Search Report dated Jan. 28, 2000.
P. Guillon et al.: "Microstrip Bandstop Filter Using a Dielectric Resonator", IEEE Proceedings H. Microwaves, Antennas & Propagation, vol. 128, No. 3, Jun. 1981, pp. 151–154.

* cited by examiner

*Primary Examiner*—Don Wong
*Assistant Examiner*—Shih-Chao Chen
(74) *Attorney, Agent, or Firm*—Ostrolenk, Faber, Gerb & Soffen, LLP

(57) ABSTRACT

A resonance device with strengthened coupling between a resonator and a transmission line without reducing an unloaded Q of the resonator. The resonance device includes a micro-strip line as a transmission line, which has a dielectric substrate, a main conductor, and an earth conductor, both of which are formed on the dielectric substrate, and a resonator disposed near the main conductor of the micro-strip line to be electromagnetically coupled thereto. At a part of the main conductor of the micro-strip line where it is coupled to the resonator, an electrodeless portion such as a slit is formed in a direction substantially parallel to a signal-propagating direction.

24 Claims, 14 Drawing Sheets

RESONANCE DEVICE, AND OSCILLATOR, FILTER, DUPLEXER AND COMMUNICATION DEVICE INCORPORATING SAME

BACKGROUND OF THE INVENTION

1. Field of the Invention

The present invention relates to a resonance device in which a transmission line such as a micro-strip line or a coplanar line is coupled to a resonator. In addition, the invention relates to an oscillator, a filter, a duplexer, and a communication device incorporating the same.

2. Description of the Related Art

A conventional resonance device will be illustrated referring to FIG. 12. This figure is a perspective view of the conventional resonance device.

The conventional resonance device 110 shown in FIG. 12 is constituted of a micro-strip line 120 as a transmission line and a resonator 111. The micro-strip line 120 is composed of a dielectric substrate 121, a main conductor 122 formed on the upper surface thereof and an earth conductor 123 formed on the lower surface thereof. The resonator 111 is a cylindrical dielectric member, a part of which is arranged over the main conductor 122 of the micro-strip line 120. In the resonance device 110 having such a structure, an electromagnetic field is excited surrounding the micro-strip line 120 by current flowing through the main conductor 122 of the micro-strip line 120. As a result, the electromagnetic field excited by the current is coupled to the resonator 111 so that the resonator 111 resonates in a TE01δ mode.

In general, when a resonance device is used to form an oscillator or a filter, a part of the characteristics of the oscillator or the filter depends on the strength of the coupling between a transmission line and a resonator used in the resonance device. For example, the stronger the coupling between the transmission line and the resonator, the greater the oscillating output of the oscillator, and the wider the band width characteristics of the filter.

In such a conventional resonance device, however, coupling beyond a certain level of strength cannot be obtained due to the dispersive characteristics of a micro-strip line, which will be described below. The dispersive characteristics of a micro-strip line are also described in "Microwave Planar Passive Circuits and Filters," by J. Helszajn, John Wiley & Sons, 1994, pp 90–93, and other publications. Thus, when an oscillator having a large output and a-filter having wide frequency bandwidth characteristics are desired, since it is impossible to make the coupling between the transmission line and the resonator stronger than a certain level, there is a problem in that an oscillator and a filter having such desired characteristics cannot be obtained.

Referring to FIG. 13, a description will be given of the problem. FIG. 13 is a graph showing the result of a simulation about the reflection characteristics of a resonance device with respect to a frequency. In this figure, reference numerals S11 indicates the value of reflection characteristics, which is a ratio of output-signal strength/input-signal strength obtained when a signal is input from one side of a micro-strip line shown in FIG. 12 and an output signal is observed on the same side.

The resonance device used in the simulation has a structure shown in FIG. 12, in which the relative permittivity of the dielectric substrate 121 of the micro-strip line 120 is set to be 3.2, the thickness of the dielectric substrate 121 is set to be 0.3 mm, and the line width of the main conductor 122 is set to be 0.72 mm. In addition, the relative permittivity of the resonator 111 is set to be 24, the diameter thereof is set to be 2.0 mm, and the thickness thereof is set to be 0.8 mm. As indicated by the graph shown in FIG. 13, in the conventional resonance device 110, the reflection characteristics is 3 dB when the resonating frequency is 28.5 GHz. In other words, this shows a fact that in the case of such a conventional resonance device, many signals pass through without being reflected at a resonance frequency, with an implication that coupling between the micro-strip line 12 and the resonator 111 in the resonance device 110 is weak.

A description will be given below about the reason why the coupling between the transmission line and the resonator in the conventional resonance device is weak. This is a case in which a micro-strip line is used as the transmission line.

In general, in a micro-strip line, it is ideal that an electromagnetic field excited by current flowing through a main conductor all exists on a surface vertical to a signal-propagating direction. However, in fact, an electromagnetic field is distributed both in an air space around the micro-strip line and in a dielectric substrate. Since the permittivity of the air space and that of the dielectric substrate are different, a phase velocity of the electromagnetic field is different between the air space and the dielectric substrate. As a result, it is impossible to obtain the ideal situation in which the electromagnetic field all exists on the surface vertical to a signal-propagating direction. That is, in this situation, the electromagnetic field excited by current flowing through the main conductor includes a component parallel to a signal-propagating direction. FIGS. 14A and 14B each show the distribution of the electromagnetic field having the component parallel to a signal-propagating direction. FIG. 14A shows the distribution of an electric field and FIG. 14B shows that of a magnetic field.

According to an equivalent principle, in the conventional resonance device, the electromagnetic field associated with coupling between the resonator and the transmission line is an electromagnetic field in a direction substantially vertical to a signal-propagating direction. In contrast, the electromagnetic field in a direction parallel thereto is not associated with coupling between the resonator and the transmission line. In other words, when the electromagnetic-field component parallel to a signal-propagating direction is increased, it is suggested that this increases an undesired electromagnetic-field component in terms of the coupling between the resonator and the transmission line. Thus, this is a factor that weakens the coupling between them.

Meanwhile, the higher the frequency, the larger the electromagnetic-field component parallel to a signal-propagating direction. This will be described referring to FIG. 15, which shows the relationship between an effective relative permittivity and a frequency. In addition, a micro-strip line used in this situation has a structure shown in FIG. 12, in which the relative permittivity of the dielectric substrate 121 is set to be 3.2, the thickness of the dielectric substrate 121 is set to be 0.3 mm, and the line width of the main conductor 122 is set to be 0.72 mm.

In the micro-strip line shown in FIG. 12, as described above, although the electromagnetic field is distributed both in the air space around the micro-strip line and in the dielectric substrate, the permittivity of the air space is different from that of the dielectric substrate. As a result, energy existing in the air space flows into the dielectric substrate by which distortion occurs in the distributions of the electromagnetic field, with the result that an electromagnetic-field component parallel to a signal-propagating direction is generated. In other words, the higher the proportional amount of energy existing in the dielectric substrate, the larger the electromagnetic field-component parallel to a signal-propagating direction, which weakens coupling between the resonator and the transmission line.

Next, a description will be given of the relationship between the ratio of the amount of energy existing in the dielectric substrate and an effective relative permittivity. For example, when the relative permittivity of the dielectric substrate is indicated by the symbol er and the ratio between the energy existing in the air space and that in the dielectric substrate is set to 1:1, the effective relative permittivity indicated by the symbol e eff is approximately equal to $(1+\epsilon r)/2$. When the energy existing in the dielectric substrate is increased and the ratio between the energy existing in the air space and that in the dielectric substrate is set to 1:2, the effective relative permittivity $\epsilon$ eff is approximately equal to $(1+2\epsilon r)/3$. In this situation, the value of $\epsilon$ eff is closer to that of er. That is, the increase in the proportional amount of the energy existing in the dielectric substrate is equivalent to how close the effective relative permittivity is to the relative permittivity of the dielectric substrate.

FIG. 15 is a graph showing the relationship between a frequency and an effective relative permittivity. In this figure, at a frequency of 30 GHz, the effective relative permittivity amounts to approximately 90% of the permittivity 3.2 of the dielectric substrate, and at frequencies over 30 GHz, the effective relative permittivity is closer to the permittivity of the dielectric substrate. Therefore, the higher the frequency is, the closer to the relative permittivity of the dielectric substrate the effective relative permittivity is, and at the same time, the ratio of the amount of energy existing in the dielectric substrate is increased, which leads to an increase in the electromagnetic-field component parallel to a signal-propagating direction. This parallel electromagnetic-field component is not associated with coupling between the resonator and the transmission line.

Recently, in communication equipment, the use of frequencies in a quasi-millimeter wave band or a millimeter wave band has been increasing. The use of high frequencies has become inevitable. However, as described above, there is a problem in that, the higher the frequency, the weaker the coupling between the resonator and the transmission line used in a resonance device.

An additional problem is that, in order to strengthen the coupling between the resonator and the transmission line, the resonator may be disposed close to the main conductor of the transmission line. However, when the amount that the main conductor of the transmission line is inserted into a resonating space is increased, conductor losses are increased, which causes a problem in that an unloaded Q of the resonator is reduced.

SUMMARY OF THE INVENTION

Accordingly, the present invention is directed to solving these problems and providing a resonance device capable of strengthening coupling between a resonator and a transmission line without shortening the distance between the resonator and the transmission line, and an oscillator, a filter, a duplexer, and a communication device incorporating the same.

To this end, according to a first aspect of the present invention, there is provided a resonance device including a transmission line formed by a dielectric substrate, a main conductor, and an earth conductor, both of the conductors being formed on the dielectric substrate, and a resonator disposed in proximity to the main conductor of the transmission line and electromagnetically coupled to the transmission line. In this arrangement, at least one electrodeless portion is formed in a part of the main conductor of the transmission line, the part being coupled to the resonator.

In the resonance device, formation of the electrodeless portion, which is advantageously a slit, permits current flowing in a direction vertical to a signal-propagating direction to be cut off, by which the occurrence of an electromagnetic field in a direction parallel to the signal-propagating direction is suppressed in response to the cut-off of current. As a result, the ratio of the electromagnetic-field component parallel to the signal-propagating direction as an undesired electromagnetic-field component in the coupling between the resonator and the transmission line is reduced, and the ratio of the electromagnetic-field component in a direction vertical thereto is thereby increased, by which the coupling between the resonator and the transmission line can be strengthened. Preferably, the electrodeless portion has the form of a slit and is formed along a direction in which the main conductor of the transmission line extends.

In addition, according to a second aspect of the present invention, there is provided an oscillator including the resonance device described above, a casing containing the resonance device, and a printed circuit board.

Furthermore, according to a third aspect of the present invention, there is provided a communication device including at least one of a transmission circuit and a reception circuit, and an antenna, in which one of the transmission circuit and the reception circuit has an oscillator, which is an oscillator as described above.

Furthermore, according to a fourth aspect of the present invention, there is provided a filter including the resonance device described above and an input/output connector.

Furthermore, a duplexer in accordance with a fifth aspect of the present invention includes at least two filters, input/output connectors for connecting to the filters, and an antenna connector for commonly connecting to the filters. At least one of the filters in the duplexer is a filter as described above.

Furthermore, a communication device in accordance with a sixth aspect of the present invention includes the duplexer described above, a transmission circuit for connecting to at least one input/output connector of the duplexer, a reception circuit for connecting to at least one input/output connector of the duplexer, which is different from that for connecting to the transmission circuit, and an antenna for connecting to the antenna connector of the duplexer.

This arrangement strengthens the coupling between the resonator and the transmission line so as to obtain an oscillator with a large output, a filter with wider band frequency characteristics, and the like.

Other features and advantages of the invention will be understood from the following detailed description of embodiments thereof, with reference to the drawings.

DESCRIPTION OF THE PREFERRED EMBODIMENTS

Figure 1:
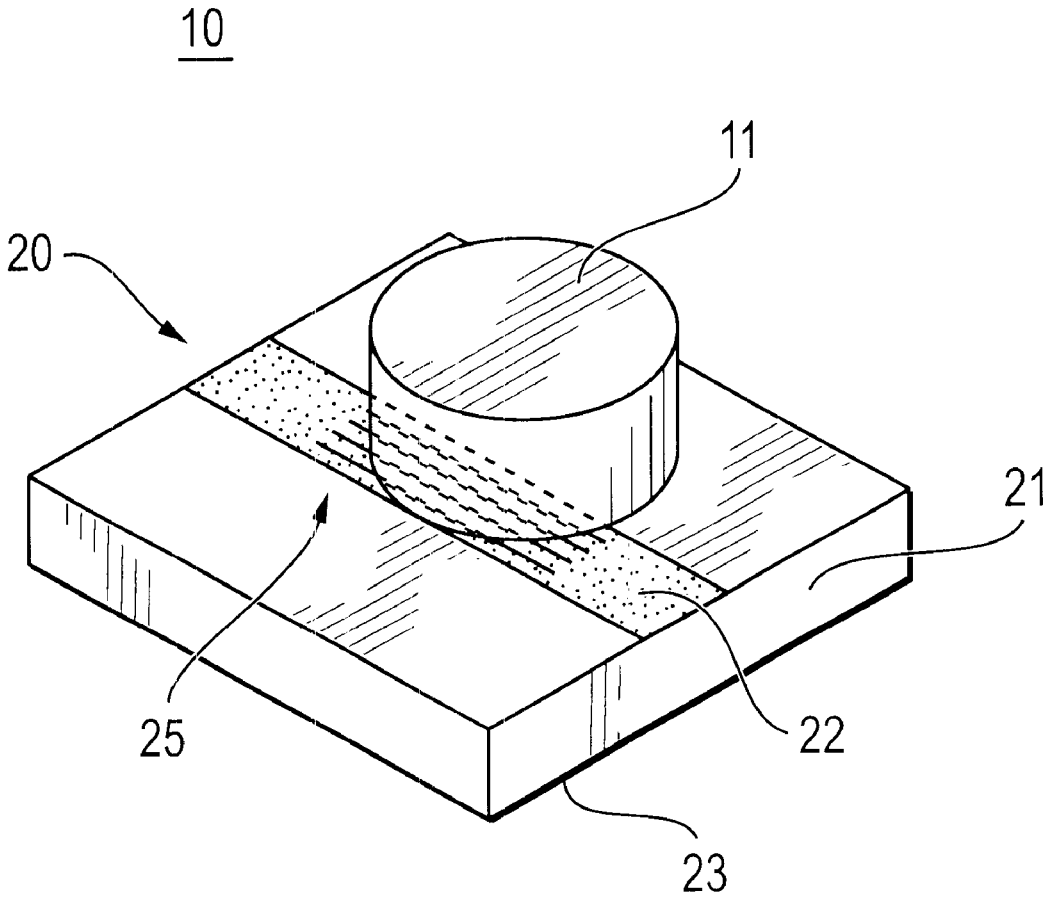
FIG. 1 is a perspective view of a resonance device according to a first embodiment of the present invention.

Referring now to FIG. 1, a description will be given of a resonance device of a first embodiment of the present invention. FIG. 1 is a perspective view of the resonance device of the first embodiment.

The resonance device 10 of the first embodiment shown in FIG. 1 is constituted of a micro-strip line 20 as a transmission line and a resonator 11. The micro-strip line 20 is formed by a dielectric substrate 21, a main-conductor 22 formed on a surface of the dielectric substrate 21, and an earth conductor 23 formed on the back surface of the dielectric substrate 21. The resonator 11 is a cylindrical dielectric member, a part of which is arranged over the main conductor 22 of the micro-strip line 20. In the resonance device 10 having such a structure, current flowing through the main conductor 22 of the micro-strip line 20 excites an electromagnetic field surrounding the micro-strip line 20. As a result, the electromagnetic field excited by the current is coupled to the resonator 11 so as to resonate the resonator 11 in the TEO1δ mode.

Figure 2:
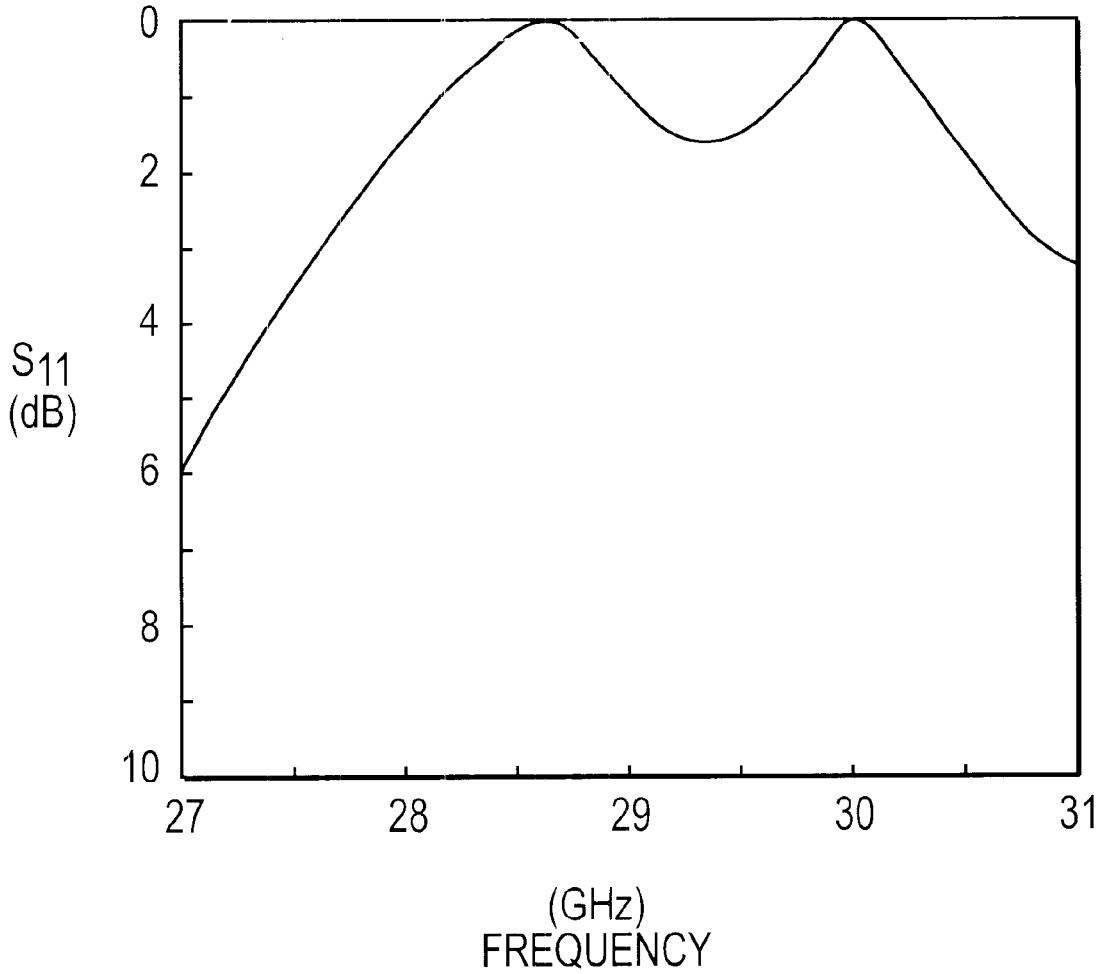
FIG. 2 is a graph showing reflection characteristics with respect to frequency in the resonance device of the present invention.

In this embodiment, as shown in FIG. 1, at the part where the resonator 11 is coupled to the micro-strip line 20, four slits 25 are disposed in a direction parallel to a signal-propagating direction. FIG. 2 is a graph showing the result of a simulation of the reflection characteristics of the resonance device 10 with respect to frequency under this situation.

The resonance device used in the simulation has the structure shown in FIG. 1. In this micro-strip line 20, the relative permittivity of the dielectric substrate 21 is set to be 3.2, the thickness of the dielectric substrate 21 is set to be 0.3 mm, and the line width of the main conductor 22 is set to be 0.72 mm. In addition, the relative permittivity of the resonator 11 is set to be 24, the diameter thereof is. set to be 2.0 mm, and the thickness of thereof is set to be 0.8 mm. As the graph shown in FIG. 2, in the resonance device 10 of the first embodiment, the reflection characteristics obtained at 30 GHz as the center frequency in the design of the device is approximately 0 dB. In other words, in the resonance device 10, almost total reflection is performed at a resonance frequency, which implies that coupling between the resonator 11 and the micro-strip line 20 is strong. In this embodiment, since the slits 25 are disposed in parallel to a signal-propagating direction, the current vertical to the signal-propagating direction is cut off. As a result, an electromagnetic-field component in a direction parallel to the signal-propagating direction, which is a component excited by current vertical to the signal-propagating direction, is not generated and the ratio of the electromagnetic-field component in a direction vertical thereto is thereby increased. Accordingly, with no deterioration of the unloaded Q of the resonator 11 caused by making the distance between the main conductor 22 of the micro-strip line 20 and the resonator 11 closer, the coupling between the resonator 11 and the micro-strip line 20 can be strengthened.

Figure 16:
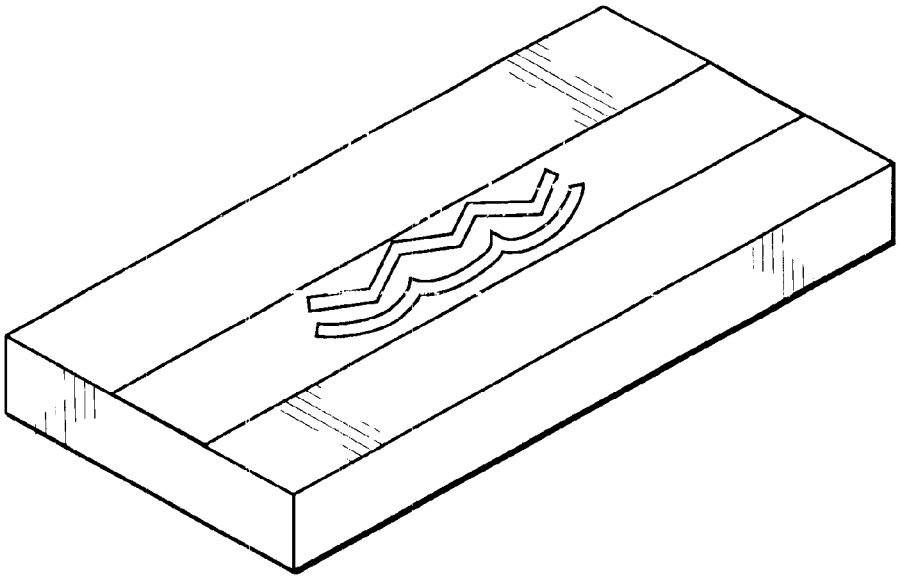
FIGS. 16 and 17 show other types of strip lines used in resonance devices according to other embodiments of the present invention.
Figure 17:
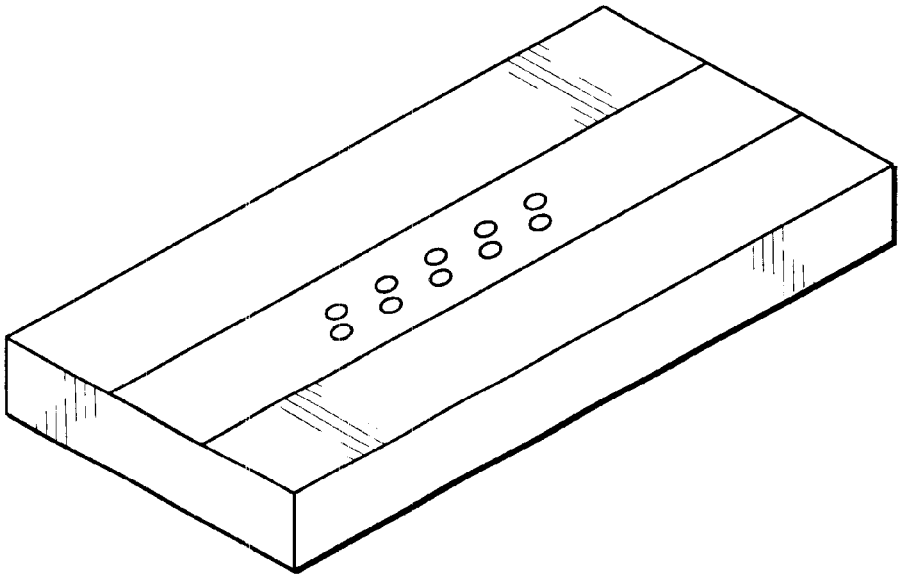

In other embodiments of the invention, instead of a slit, a wave-shaped groove as shown in FIG. 16 can also be used. Alternatively, as shown in FIG. 17, a contiguous sequence of plural openings can also be used to form a broken slit similar to the slit in FIG. 1. The precise arrangement of the openings is not critical, as long as the current vertical to a direction in which a signal propagates through the main conductor is more or less cut off by the electrodeless portions. The degree of cutting-off can be selected suitably according to the use of the resonator.

Figure 3:
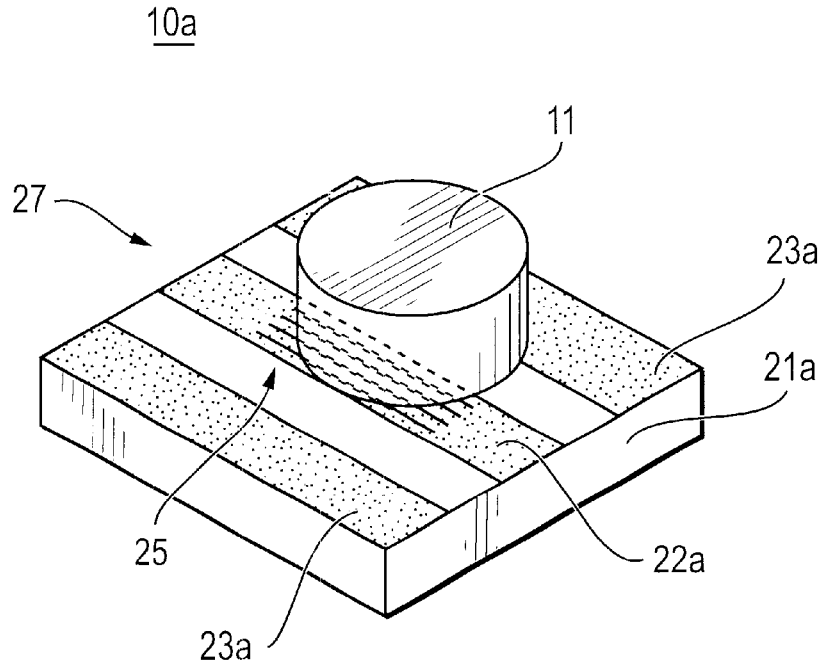
FIG. 3 is a perspective view of a modification of the resonance device according to the first embodiment.

Although this embodiment adopts a micro-strip line as the transmission line, other arrangements can be used. For example, in the perspective view of a resonance device 10*a* shown in FIG. 3, the resonance device uses a coplanar line 27, in which a main conductor 22*a* is formed on an upper surface of the dielectric substrate 23*a*, and at both sides of the main conductor 22*a*, an earth conductor 23*a* is formed.

Figure 4:
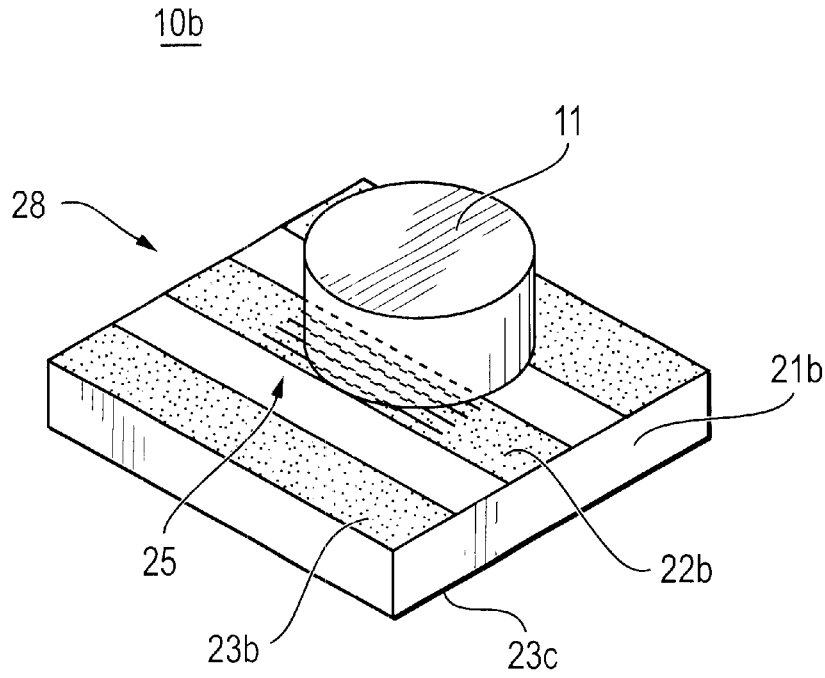
FIG. 4 is a perspective view of another modification of the resonance device according to the first embodiment.

In addition, as in the perspective view of a resonance device 10*b* shown in FIG. 4, the resonance device 10*b* uses a grounded coplanar line 28 in which a main conductor 22*b* is formed on a surface of a dielectric substrate 21*b*, and an earth conductor 23*b* is formed at both sides of the main conductor 22*b*. On the lower surface of the dielectric substrate 21*b* is formed an earth conductor 23*c*.

In both resonance devices 10*a* and 10*b*, the advantages of the present invention can be obtained by forming the slit 25 in a direction in which a signal propagates through each of the main conductors 22*a* and 22*b*.

Figure 5:
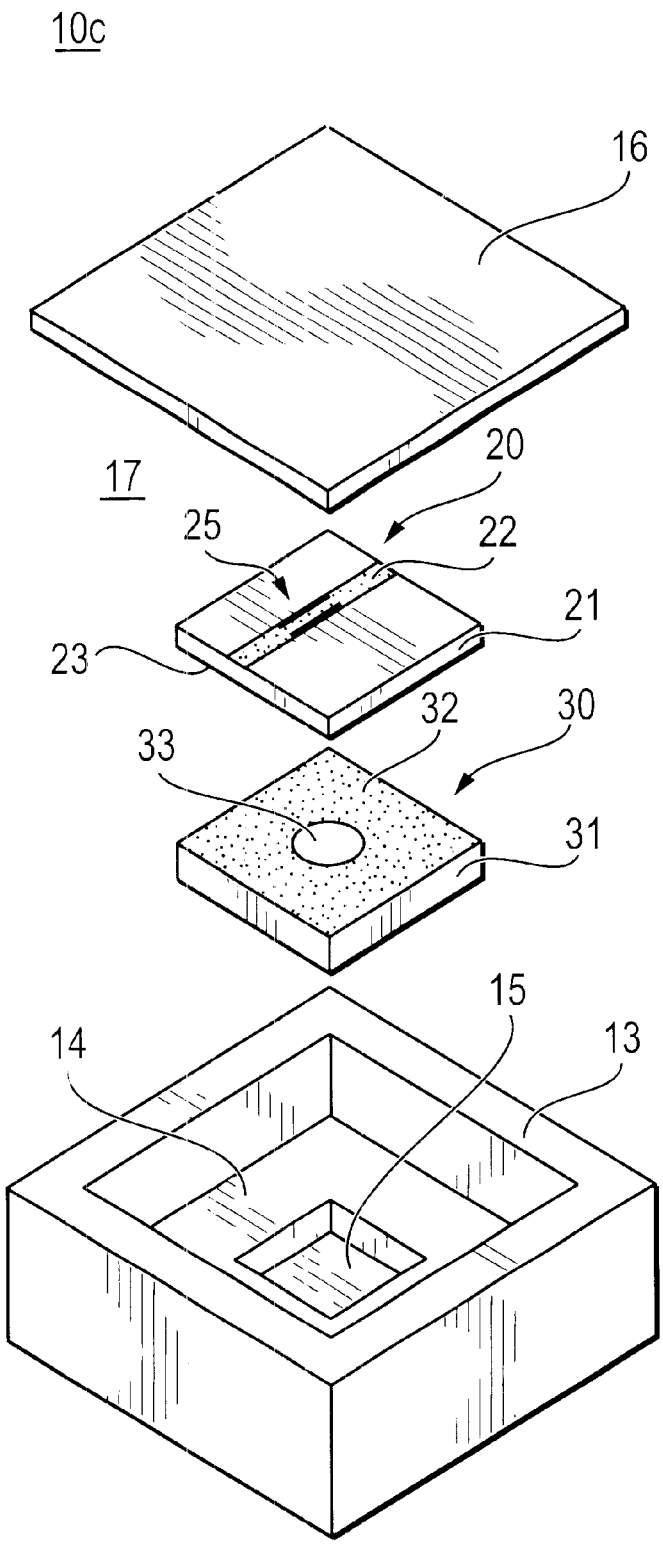
FIG. 5 is a perspective view of a resonance device according to a second embodiment of the present invention.

Next, a resonance device in accordance with a second embodiment of the present invention will be illustrated referring to FIG. 5. FIG. 5 is a perspective view of the resonance device of the second embodiment. As shown in FIG. 5, the resonance device 10*c* of the embodiment is constituted of a rectangular-shaped resonator unit 30 in which an electrode 32 is formed on the mutually opposing main surfaces of a dielectric substrate 31, a metal casing 13 for containing the resonator unit 30, and a metal top cover 16. In the electrodes 32 formed on the two main surfaces of the resonator unit 30, substantially circular openings 33 are opposed approximately at the centers of the electrodes. In the metal casing 13 containing the resonator unit 30, recesses 14 and 15 defined respectively by two steps are formed. The second stepped recess 15 forms an empty space around the opening 33 on the lower surface of the resonator unit 30 when the resonator unit 30 is disposed in the first stepped recess 14, which is a size larger than the resonator unit 30 contained in the metal casing 13. In this way, the resonance device is formed by the resonator unit 30, the metal casing 13, and the top cover 16. In addition, a printed circuit board 17 having the micro-strip line 20 as a transmission line thereon is mounted on the resonator unit 30. The micro-strip line 20 is constituted of the dielectric substrate 21, the main conductor 22 formed thereon, and the earth conductor 23 formed on the part except the opening 33 of the resonator unit 30 on the lower surface of the dielectric substrate 21. The micro-strip line 20 is disposed over the opening 33 of the resonator unit 30, by which the micro-strip line 20 is coupled to the resonator formed by the opening 33 so as to resonate the resonator in a TE010 mode. Furthermore, in the main conductor 22 of the micro-strip line 20, at the part over the opening 33 of the resonator unit 30, a slit 25 is formed in a direction parallel to a signal-propagating direction.

Figure 6:
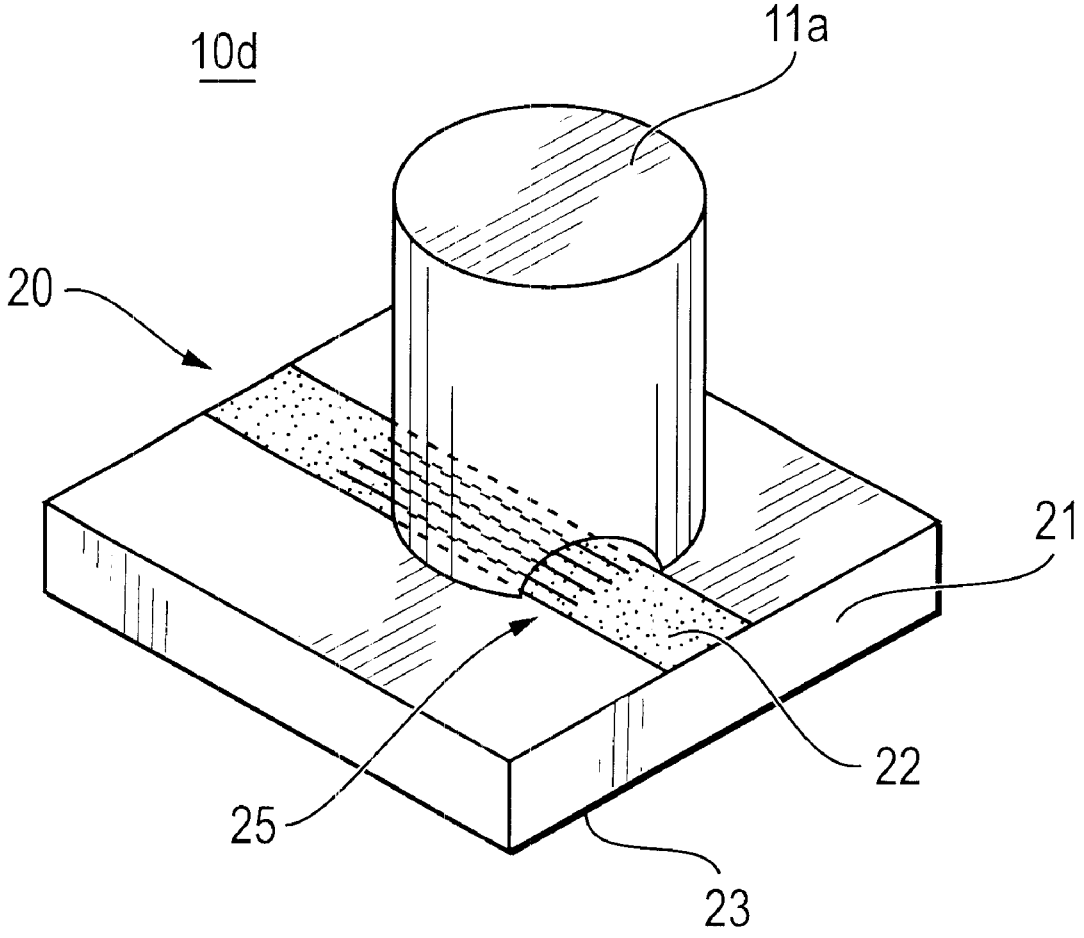
FIG. 6 is a perspective view of a resonance device according to a third embodiment of the present invention.

Next, a resonance device in accordance with a third embodiment of the present invention will be illustrated referring to FIG. 6. FIG. 6 is a perspective view of the resonance device of the third embodiment. The same parts as those in the first embodiment are given the same reference numerals and the detailed explanation thereof is omitted.

As shown in FIG. 6, a resonance device 10*d* used in the embodiment is constituted of a micro-strip line 20 as a transmission line and a resonator 11*a*. In this embodiment, a hollow resonator formed of a metal cylinder is used as the resonator 11*a*. Alternatively the resonator 11*a* may be a hollow dielectric cylinder on which a metal layer is coated. In either case, a part of the hollow cylinder is cut away to prevent it from being short-circuited with the metal strip line 20. The resonator 11*a* resonates in a TE011 mode by being coupled to the micro-strip line 20. The height of the cylinder may be selected in accordance with the desired resonant frequency of the resonator. In addition, slits 25 are formed at a part of the main conductor 22 of the micro-strip line 20, the part being coupled to the resonator 11*a*, in a direction parallel to a signal-propagating direction.

Figure 7:
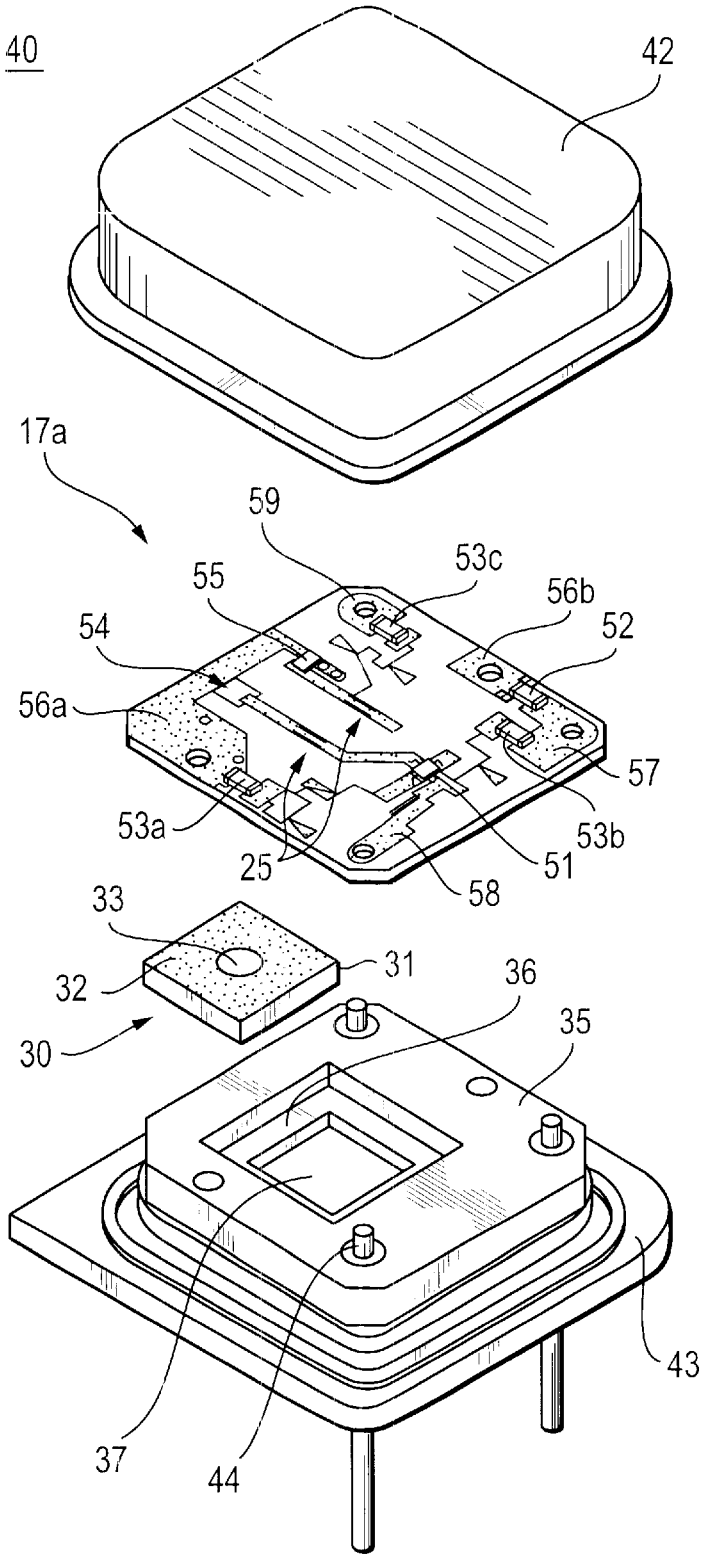
FIG. 7 is an exploded perspective view of an oscillator according to an embodiment of the present invention.

Next, the oscillator of the present invention will be illustrated referring to FIG. 7. The figure is an exploded perspective view of the oscillator of the embodiment.

As shown in FIG. 7, an oscillator 40 used in this embodiment is constituted of a cap 42, a stem 43, a casing 35, a resonator unit 30, and a printed circuit board 17*a*. The cap 42, the casing 35, and the stem 43 are formed of iron so that they have approximately the same linear expansivity as that of the resonator unit 30. The cap 42 and the stem 43 are mutually bonded by a hermetic seal. In addition, at each of the three comers of the stem 43, a terminal pin 44 is disposed.

In the resonator unit 30, an electrode 32 is formed on each of the opposing surfaces of a rectangular dielectric substrate 31, and substantially circular openings 33 are opposed approximately at the centers of the electrodes 32. The resonator unit 30, the cap 42, and the stem 43 having the above-described structure form a resonance device, in which the concentration of an electromagnetic field occurs at the part near the substantially circular-openings 33.

Substantially at the center of the casing 35 is disposed a larger-sized first step recess 36 than the resonator unit 30, and a second step recess 37 is also disposed to make an empty space around the opening 33 of the lower surface of the resonator unit 30. The resonator unit 30 is disposed in the first step recess 36.

The printed circuit board 17*a* has an arrangement such that a main conductor is disposed on the-upper surface of a dielectric substrate formed of BT resin (a registered trademark of Mitsubishi Gas Chemical Co., Ltd.), which is frequently used as a dielectric substrate. Other dielectric materials can be freely selected according to the desired application. An earth conductor is disposed on the lower surface thereof by forming a pattern of micro-strip lines, where an FET 51, a chip capacitor 52, chip resistors 53*a*, 53*b*, and 53*c*, a film-formed terminating resistor 54, and a varactor diode 55 are disposed together. One end of a main line formed by the micro-strip line is connected to the gate of the FET 51 by wire bonding, and the other end thereof is connected to the film-formed terminating resistor 54. The micro-strip line connected to the source of the FET 51 is also connected to an earth electrode 56*a* via the chip resistor 53*a*. In addition, one end of the micro-strip line connected to the drain of the FET 51 is connected to an input terminal electrode 57 via the chip resistor 53*b*. The input terminal electrode 57 is connected to an earth electrode 56*b* via the chip capacitor 52. The other end of the micro-strip line connected to the drain of the FET 51 is connected to an output terminal electrode 58 via a capacitor component produced by disposing a gap.

A specified part of a sub line formed by the micro-strip line is connected-to the earth electrode 56*a* via the varactor diode 55. In addition, thee micro-strip line extracted from another position is connected to a bias terminal electrode 59 via the chip resistor 53*c*. When a voltage is applied to the varactor diode 55, the capacitance of the varactor diode 55 is changed so that the oscillation frequency of the oscillator 40 can be changed.

In this situation, the casing 35 is disposed on the stem 43 and the resonator unit 30 is contained in the recess 36 of the casing 35, on which the printed circuit board 17*a* is mounted. The terminal pins 44 disposed at the three corners of the casing 35 and the stem 43 are inserted into holes disposed at the respective parts of the input/output terminal electrode 57, the output terminal electrode 58, and the bias terminal electrode 59 to be connected to each of the terminal electrodes. The holes disposed in the printed circuit board 17*a* have the same configurations as those of the terminal pins 44 so as to keep the holes in constant connection to the pins 44.

Furthermore, slits 25 are formed at parts where the main line and the sub line formed on the printed circuit board 17*a* are each coupled to the resonator in a direction parallel to a signal-propagating direction. This arrangement strengthens coupling between the resonator and the transmission line so as to obtain an oscillator having a large output.

Figure 8:
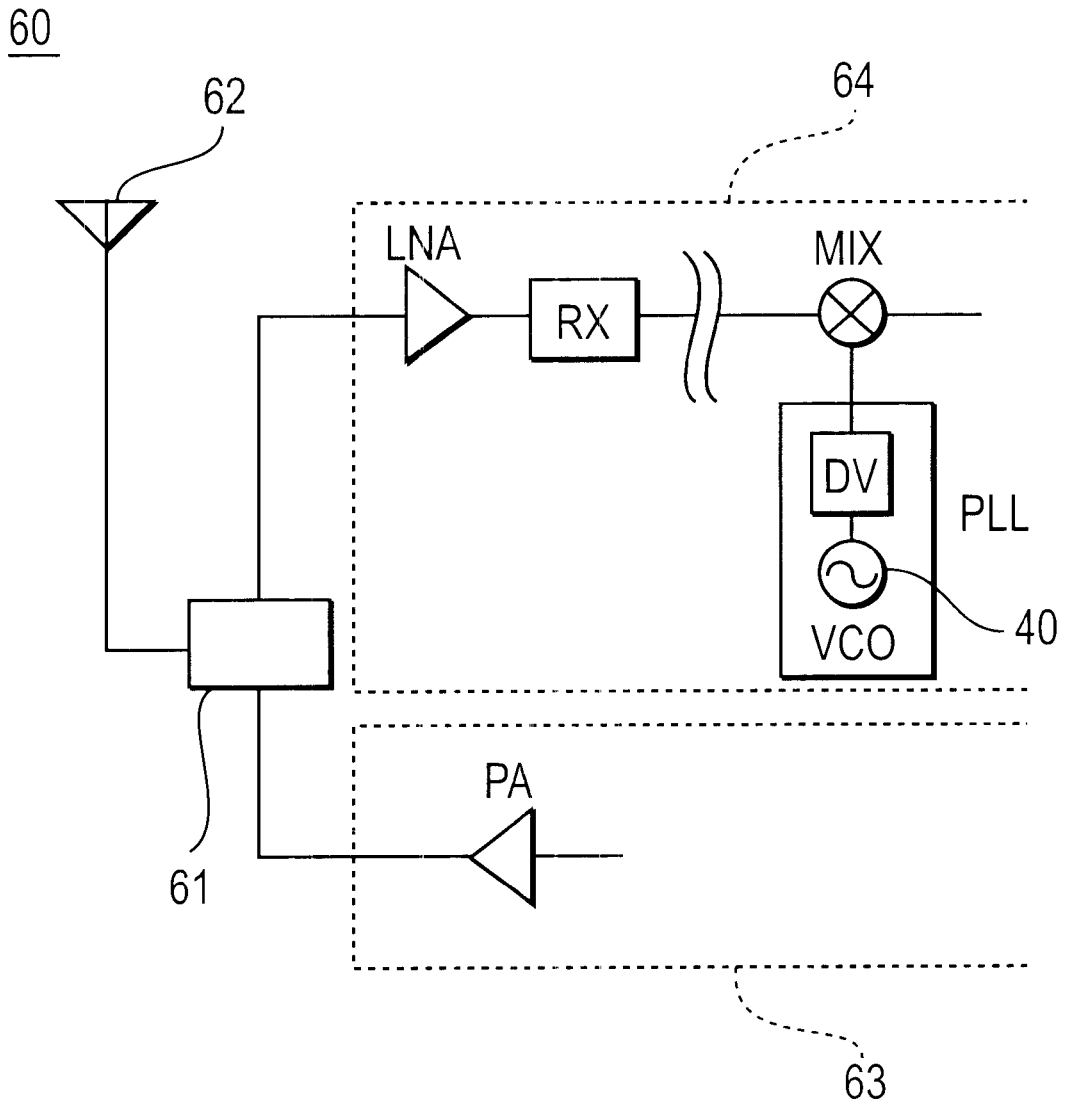
FIG. 8 is a schematic view of a communication device in accordance with an embodiment of the present invention.

Next, a communication device of an embodiment of the present invention will be illustrated referring to FIG. 8. The figure is a schematic view of the communication device of the present invention.

As shown in FIG. 8, a communication device 60 of the present invention is constituted of a duplexer 61 including a transmission filter and a reception filter, an antenna 62 connected to the antenna connecting terminal of the duplexer 61, a transmission circuit 63 connected to an input/output terminal of the transmission filter of the duplexer 61, and a reception circuit 64 connected to an input/output terminal of the reception filter thereof.

The transmission circuit 63 includes a power amplifier (PA), by which a transmitted signal is amplified and is outputted from the antenna 62 via the transmission filter. On the other hand, a received signal is sent to the reception circuit 64 from the antenna 62 via the reception filter and is inputted to a mixer after passing through a low noise amplifier (LNA) and a filter (RX) in the reception circuit 64. Furthermore, a local oscillator formed by a phase-locked loop (PLL) includes an oscillator 40 (VCO) and a divider (DV) to output a local signal to the mixer, from which an intermediate frequency is outputted.

In the communication device 60, any one of the duplexer 61, the filter (RX), and the oscillator 40, at least, can comprise a resonance device or a filter according to an embodiment of the invention.

Figure 9:
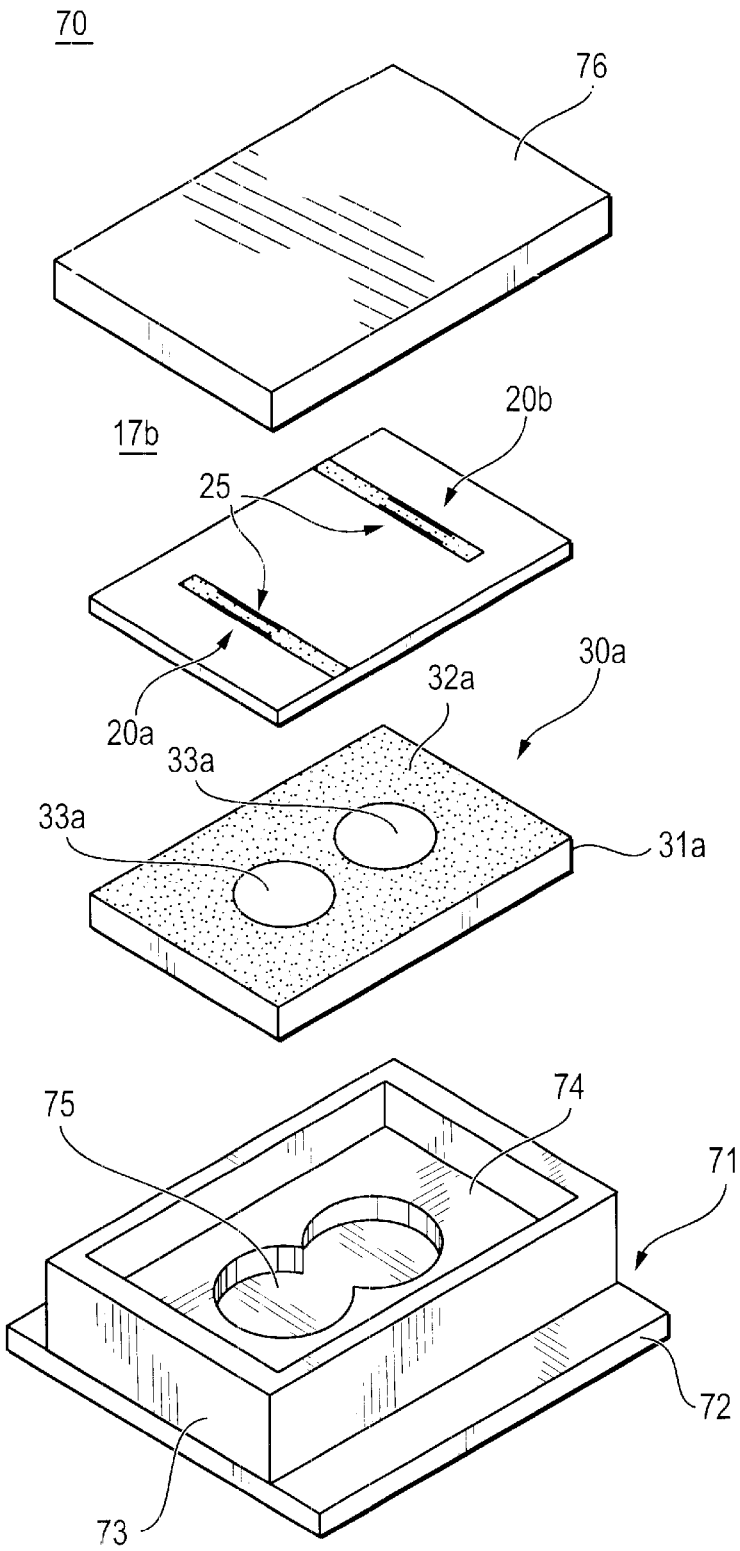
FIG. 9 is an exploded perspective view of a filter in accordance with an embodiment of the present invention.

Referring now to FIG. 9, a dielectric filter in accordance with an embodiment of the present invention will be illustrated below. FIG. 9 is an exploded perspective view of the dielectric filter of the embodiment.

As shown in FIG. 9, a filter 70 of the embodiment is constituted of a resonator unit 30*a*, in which an electrode 32*a* is formed on each of the opposing surfaces of a dielectric substrate 31*a*, a printed circuit board 17*b* mounted on the resonator unit 30*a*, a lower casing 71, and an upper casing 76. At the center of the electrode 32*a*, two circular openings 33*a* are formed, and at the opposing central position of the back-surface electrode, the same-shaped openings are also formed. The part defined by the openings 33*a*, and the upper and lower casings 71 and 76 form a resonance device. The resonating frequency of the resonance device is determined by the shape of the openings 33*a*, the thickness of the dielectric substrate 31*a*, and the like.

The lower casing 71 is formed by a substrate 72 and a metal frame 73 mounted thereon. Since the resonator unit 30*a* is contained in the metal frame 73, recesses 74 and 75 as two steps are formed inside the metal frame 73. In addition, micro-strip lines 20*a* and 20*b* as input/output connectors are formed on the printed circuit board 17*b*, which is mounted on the resonator unit 30*a* in such a manner that the micro-strip lines 20*a* and 20*b* are arranged over the openings 33*a* of the resonator unit 30*a*. Each of the micro-strip lines 20*a* and 20*b* has a longitudinal slit 25 at a part thereof where the lines are coupled to the resonators 33*a*.

In the filter 70 having the above structure, the resonator unit 30*a* is disposed in the first step recess 74 of the lower casing 71 to be fixed by a conductive adhesive. The upper casing 76 is fixed onto the metal frame 73 of the lower casing 71. When a signal is inputted to the micro-strip line 20*a*, the resonator and the micro-strip line 20*a* are coupled so that the resonator resonates in the TE010 mode. Furthermore, after the coupling between the adjacent resonators, a signal is outputted from the micro-strip line 20*b* on the output side so as to actuate the filter 70 as a band pass filter.

Figure 10:
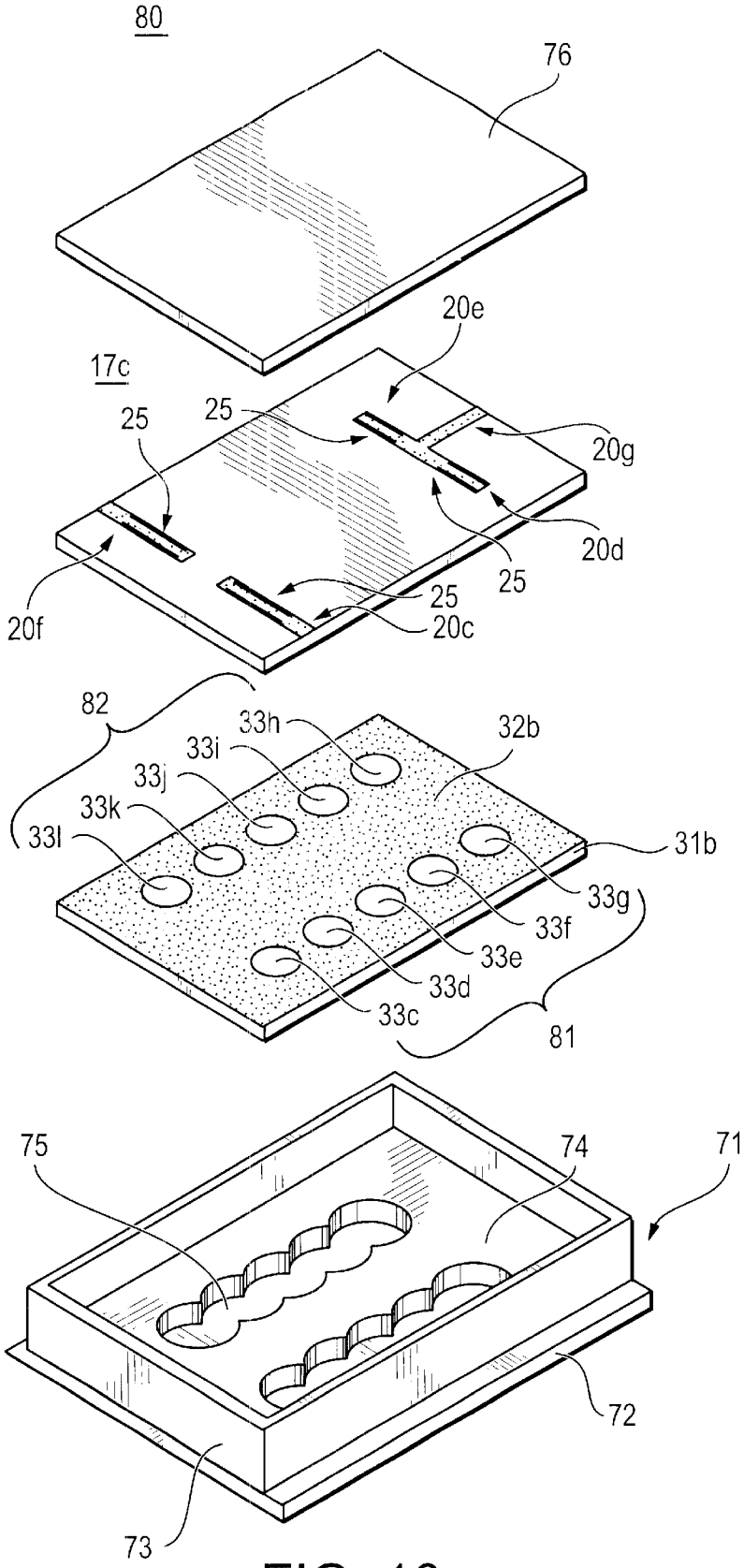
FIG. 10 is an exploded perspective view of a duplexer in accordance with an embodiment of the present invention.

In addition, a duplexer in accordance with an embodiment of the present invention will be illustrated referring to FIG. 10. This figure is an exploded perspective view of the duplexer of the embodiment, in which the same parts as those in the previous embodiment are given the same reference numerals arid the detailed explanation thereof is omitted.

As shown in FIG. 10, a duplexer 80 used in this embodiment is constituted of a first filter section 81 including five resonators formed by five openings 33*c* to 33*g* on the dielectric substrate 31*b*, on each of the main surfaces thereof being formed an electrode 32*g*, and a second filter section 82 including five resonators formed by five openings 33*h* to 33*l*. The five resonators forming the first filter section 81 are electromagnetically coupled to each other so as to form a transmitting band-pass filter. The other five resonators forming the second filter section 82, which are different from those of the first filter section 81, are also electromagnetically coupled to each other so as to form a receiving band-pass filter.

On the printed circuit board 17*c* mounted on the dielectric substrate 31*b*, micro-strip lines 20*c* to 20*f* as input/output connectors, and a micro-strip line 20*g* as an antenna connector are formed. The micro-strip line 20*c* coupled to the input-stage resonator in the first filter section 81 is connected to an external transmission circuit. In addition, the micro-strip line 20*f* coupled to the output-stage resonator in the second filter section 82 is connected to an external reception circuit. The micro-strip line 20*d* coupled to the output-stage resonator in the first filter section 81 and the micro-strip line 20*e* coupled to the input-stage resonator in the second filter section 82 are commonly connected to the micro-strip line 20*g* as the antenna connector so as to be connected to an external antenna.

In the duplexer 80 having such a structure, the first filter section 81 permits the signal of a specified frequency to pass through, and the second filter section 82 permits the signals of frequencies different from the specified frequency to pass through, so that the duplexer 80 acts as a band pass duplexer. In order to obtain isolation of the first filter section 81 and the second filter section 82, a partition is provided between the upper casing 76 and the first filter section 81 and second filter section 82 of the lower casing 71.

As described above, the micro-strip lines 20*a* and 20*b* as transmission lines are formed on the printed circuit board 17*b* of the filter 70, and the micro-strip lines 20*c* to 20*g* as transmission lines are formed on the printed circuit board 17*c* of the duplexer 80. In the main conductors of these micro-strip lines, slits 25 are formed at the parts coupled to the resonators in a direction parallel to a signal-propagating direction. This arrangement permits coupling between the resonators and the transmission lines to be stronger so as to produce a filter and a duplexer having wider band frequency characteristics.

Figure 11:
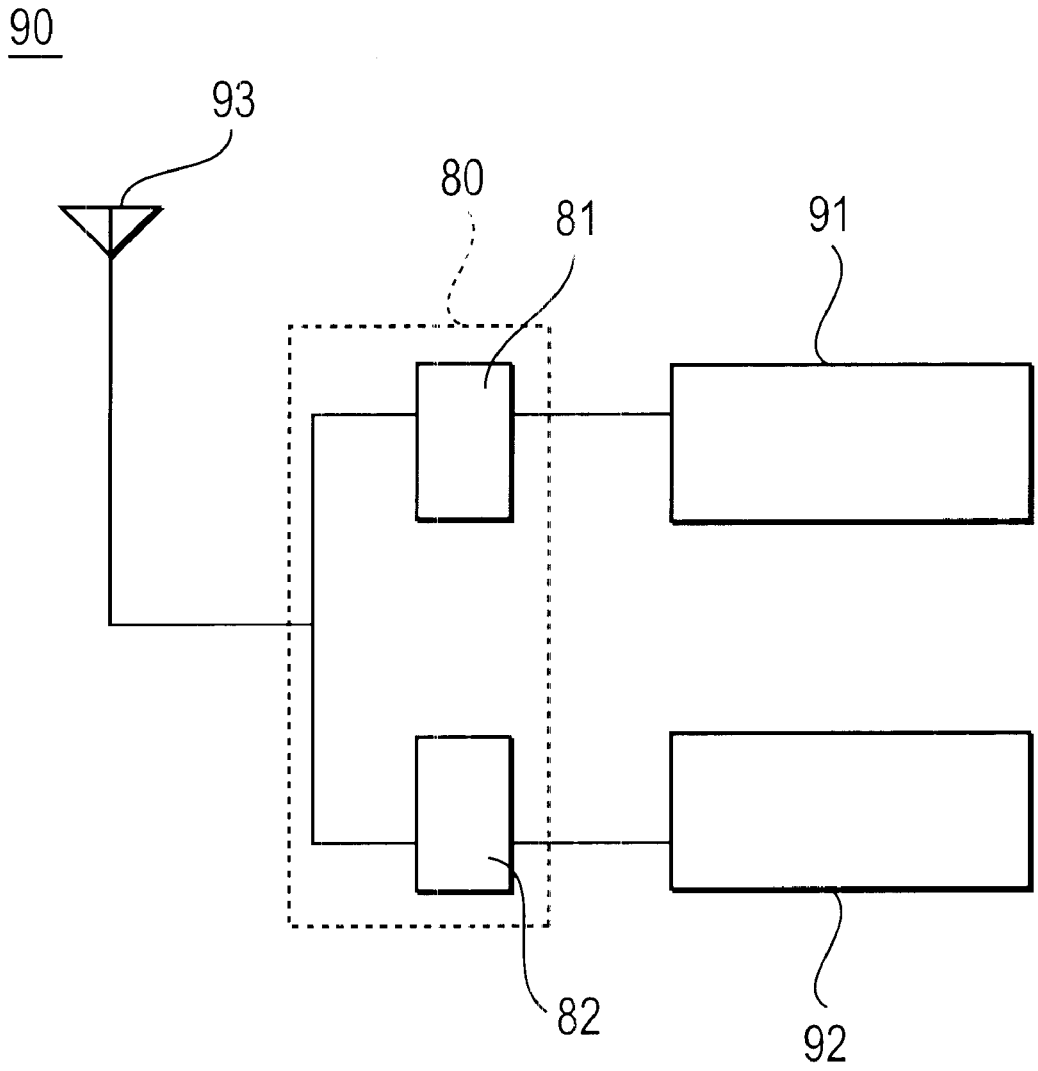
FIG. 11 is a schematic view of another communication device in accordance with an embodiment of the present invention.
Figure 12:
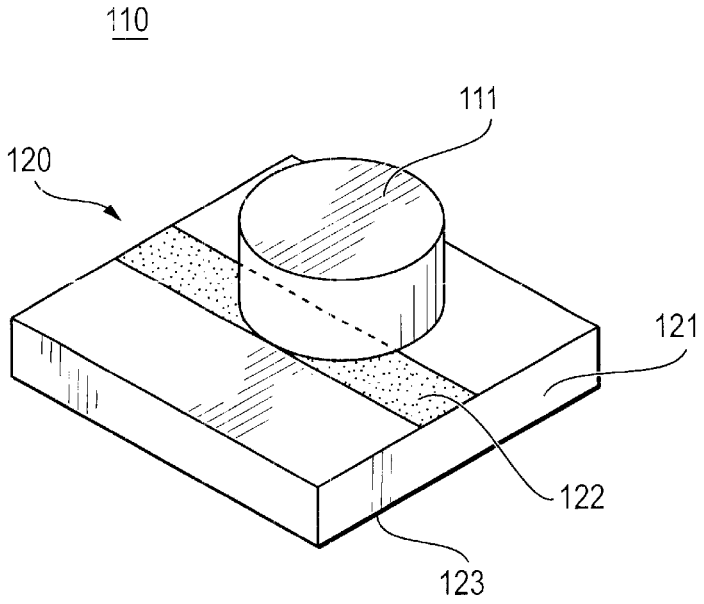
FIG. 12 PRIOR ART
FIG. 12 is a perspective view of a conventional resonance device.
Figure 13:
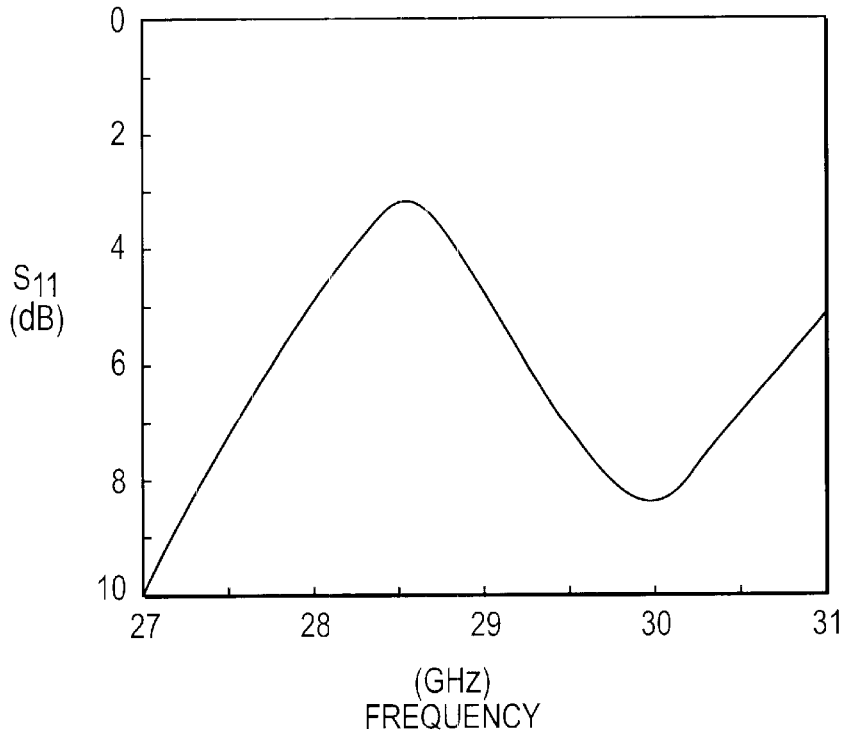
FIG. 13 PRIOR ART
FIG. 13 is a graph showing reflection characteristics with respect to frequency in the conventional resonance device.
Figure 14A:
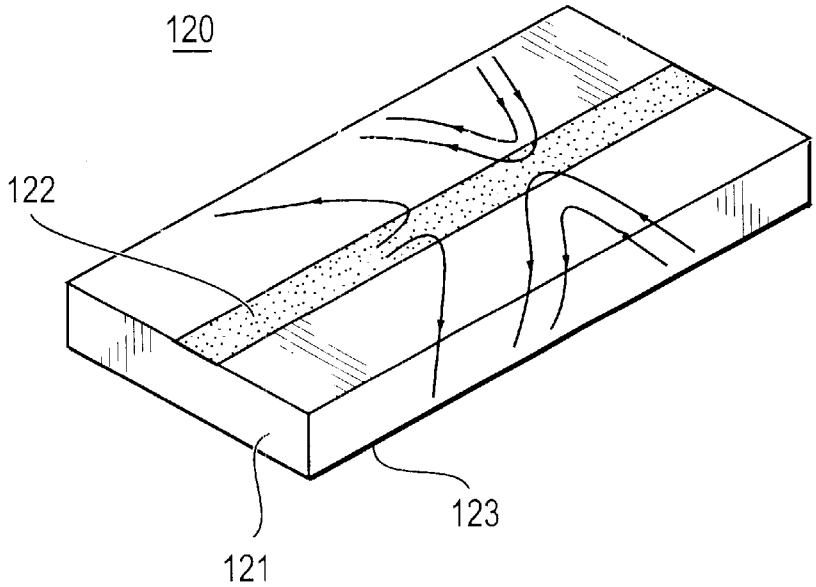
FIG. 14A PRIOR ART
FIGS. 14A and 14B each show the distribution of an electromagnetic field in a conventional micro-strip line.
Figure 14B:
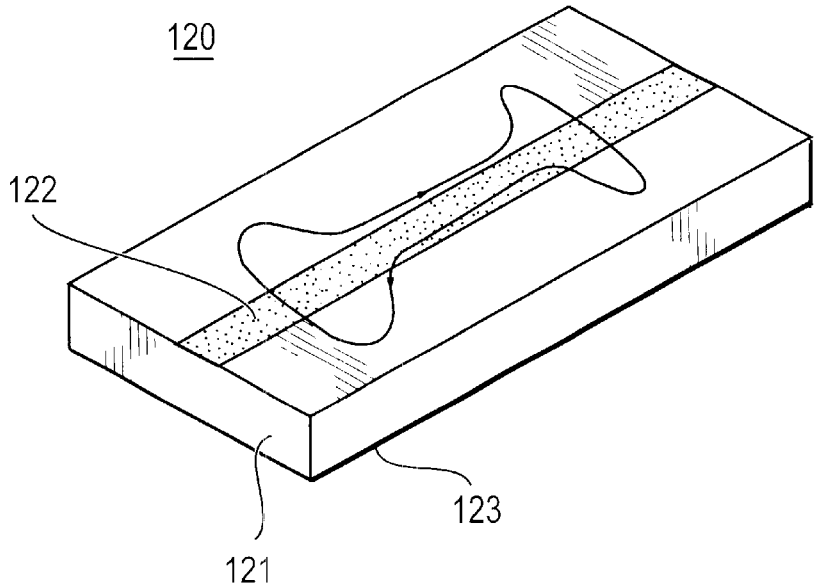
FIG. 14B PRIOR ART
Figure 15:
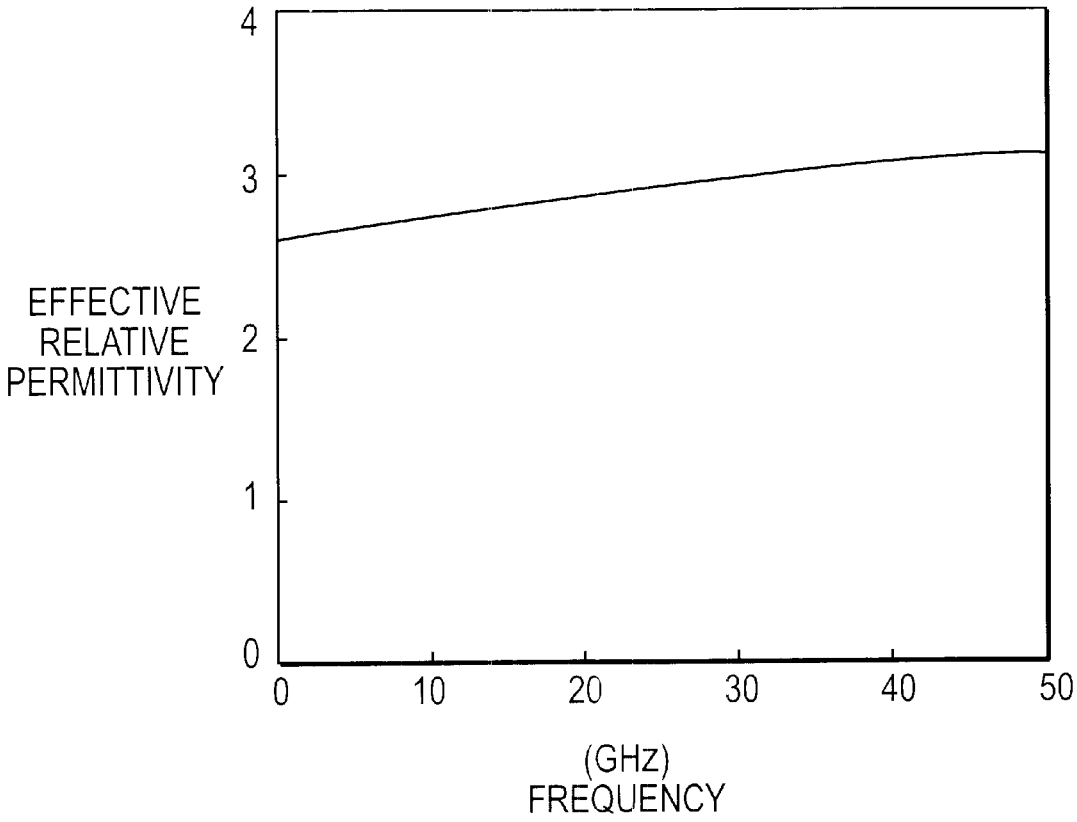
FIG. 15 PRIOR ART
FIG. 15 is a graph showing effective relative permittivity with respect to frequency in the conventional micro-strip line.

Furthermore, referring to FIG. 11, a communication device in accordance with an embodiment of the present invention, which is different from the one described in the previous embodiment, will be illustrated. FIG. 11 is a schematic view of the communication device used in this embodiment.

As shown in FIG. 11, a communication device 90 of the embodiment is constituted of a duplexer 80, a transmission circuit 91, a reception circuit 92, and an antenna 93. The duplexer 80 is equivalent to the one described above, in which the input/output connector connected to the first filter section 81 shown in FIG. 10 is connected to the transmission circuit 91, and the input/output connector connected to the second filter section 82 shown in FIG. 10 is connected to the reception circuit 92. Additionally, the antenna connector of the duplexer 80 is connected to an antenna 93.

Although embodiments of the invention have been described herein, the invention is not limited thereto, but rather extends to all equivalents, modifications and variations that would occur to those having ordinary skill in the pertinent art.

What is claimed is:

1. A resonance device comprising:

a transmission line including a dielectric substrate, a main conductor, and a pair of earth conductors, both the main conductor and the earth conductors being formed on a common surface of the dielectric substrate with the earth conductors spaced away from the main conductor on opposite sides thereof;

a resonator disposed in proximity to the main conductor of the transmission line and electromagnetically coupled to the transmission line; and at least one electrodeless portion formed in a part of the main conductor of the transmission line, the part being coupled to the resonator.

2. The resonance device according to claim 1, wherein at least one electrodeless portion is a slit which extends along a direction in which the Main conductor of the transmission line extends.

3. The resonance device according to claim 2, wherein said at least one electrodeless portion comprises a plurality of slits which extend along said direction in which the main conductor of the transmission line extends.

4. The resonance device of any one of claims 1, 2 and 3, further comprising an additional earth electrode formed on an opposite surface of said dielectric substrate from said common surface.

5. An oscillator comprising:

a resonance device comprising:

a transmission line including a dielectric substrate, a main conductor, and a pair of earth conductors, both the main conductor and the earth conductors being formed on a common surface of the dielectric substrate with the earth conductors spaced away from the main conductor on opposite sides thereof;

a resonator disposed in proximity to the main conductor of the transmission line and electromagnetically coupled to the transmission line;

at least one electrodeless portion formed in a part of the main conductor of the transmission line, the part being coupled to the resonator;

a casing containing the resonance device; and a printed circuit board.

6. The oscillator of claim 5, further comprising an additional earth electrode formed on an opposite surface of said dielectric substrate from said common surface.

7. A communication device comprising:

a circuit comprising at least one of a transmission circuit and a reception circuit;

wherein said circuit includes an oscillator, the oscillator comprising:

a resonance device comprising:

a transmission line including a dielectric substrate, a main conductor, and a pair of earth conductors, both the main conductor and the earth conductors being formed on a common surface of the dielectric substrate with the earth conductors spaced away from the main conductor on opposite sides thereof;

a resonator disposed in proximity to the main conductor of the transmission line and electromagnetically coupled to the transmission line;

at least one electrodeless portion formed in a part of the main conductor of the transmission line, the part being coupled to the resonator;

a casing containing the resonance device; and a printed circuit board.

8. A filter comprising:

a resonance device comprising:

a transmission line including a dielectric substrate, a main conductor, and a pair of earth conductors, both the main conductor and the earth conductors being formed on a common surface of the dielectric substrate with the earth conductors spaced away from the main conductor on opposite sides thereof;

a resonator disposed in proximity to the main conductor of the transmission line and electromagnetically coupled to the transmission line;

at least one electrodeless portion formed in a part of the main conductor of the transmission line, the part being coupled to the resonator, and input/output connectors for connecting the resonance device to an external circuit.

9. The filter of claim 8, further comprising an additional earth electrode formed on an opposite surface of said dielectric substrate from said common surface.

10. A duplexer comprising:

at least two filters;

input/output connectors connected in common to second ends of the filters;

wherein at least one of the filters comprises:

a resonance device comprising:

a transmission line including a dielectric substrate, a main conductor, and a pair of earth conductors, both the main conductor and the earth conductors being formed on a common surface of the dielectric substrate with the earth conductors spaced away from the main conductor on opposite sides thereof;

a resonator disposed in proximity to the main conductor of the transmission line and electromagnetically coupled to the transmission line;

a least one electrodeless portion formed in a part of the main conductor of the transmission line, the part being coupled to the resonator, and input/output connectors for connecting the resonance device to an external circuit.

11. The duplexer of claim 10, further comprising an additional earth electrode formed on an opposite surface of said dielectric substrate from said common surface.

12. A communication device comprising:

A duplexer comprising:

at least two filters;

input/output connectors connected respectively to first ends of the filters; and an antenna connector connected in common to second ends of the filters;

wherein at least one of the filters comprises:

a resonance device comprising:

a transmission line including a dielectric substrate, a main conductor, and a pair of earth conductors, both the main conductor and the earth conductors being formed on a common surface of the dielectric substrate with the earth conductors spaced away from the main conductor on opposite sides thereof;

a resonator disposed in proximity to the main conductor of the transmission line and electromagnetically coupled to the transmission line;

at least one electrodeless portion formed in a part of the main conductor of the transmission line, the part being coupled to the resonator, and input/output connectors for connecting the resonance device to an external circuit;

a transmission circuit connected to at least one input/output connector of the duplexer; and a reception circuit connected to at least one input/output connection of the duplexer, which is different from the input/output connector connected to the transmission circuit.

13. A communication device comprising:

at least one of a transmission circuit and a reception circuit;

wherein one of the transmission circuit and the reception circuit includes a filter, wherein the filter comprises:

a resonance device comprising:

a transmission line including a dielectric substrate, a main conductor, and a pair of earth conductors, both the main conductor and the earth conductors being formed on a common surface of the dielectric substrate with the earth conductors spaced away from the main conductor on opposite sides thereof;

a resonator disposed in proximity to the main conductor of the transmission line and electromagnetically coupled to the transmission line; and at least one electrodeless portion formed in a part of the main conductor of the transmission line, the part being coupled to the resonator, and input/output connectors for connecting the resonance device to an external circuit.

14. The communication device of any one of claims 7, 12 and 13, further comprising an additional earth electrode formed on an opposite surface of said dielectric substrate from said common surface.

15. A resonance device comprising:

a transmission line including a dielectric substrate, a main conductor, and an earth conductor, both the main conductor and the earth conductor being formed on the dielectric substrate;

a resonator disposed in proximity to the main conductor of the transmission line and electromagnetically coupled to the transmission line;

wherein at least one electrodeless portion is formed in a part of the main conductor of the transmission line, the part being coupled to the resonator;

wherein said at least one electrodeless portion comprises at least one slit which extends along a direction in which the main conductor of the transmission line extends; and wherein said at least one slit is non-straight.

16. The resonance device of claim 15, wherein said at least one electrodeless portion comprises a plurality of non-straight slits extending along said direction.

17. A resonance device comprising:

a transmission line including a dielectric substrate, a main conductor, and an earth conductor, both the main conductor and the earth conductor being formed on the dielectric substrate;

a TE mode resonator disposed in proximity to the main conductor of the transmission line and electromagnetically coupled to the transmission line;

wherein at least one electrodeless portion is formed in a part of the main conductor of the transmission line, the part being coupled to the resonator;

wherein said resonator is substantially hollow and said TE mode is the TE011 mode; and wherein said resonator is partly cut away to avoid contact with said main conductor.

18. An oscillator comprising:

a resonance device comprising:

a transmission line including a dielectric substrate, a main conductor, and an earth conductor, both the main conductor and the earth conductor being formed on the dielectric substrate;

a hollow TE011 mode resonator disposed in proximity to the main conductor of the transmission line and electromagnetically coupled to the transmission line;

at least one electrodeless portion formed in a part of the main conductor of the transmission line, the part being coupled to the resonator;

a casing containing the resonance device; and a printed circuit board;

wherein said resonator is partly cut away to avoid contact with said main conductor.

19. The oscillator of claim 18, further comprising a sub-line disposed on said substrate in proximity to said resonator; and at least one electrodeless portion formed in a part of the sub-line that is coupled to the resonator.

20. A filter comprising:

a resonance device comprising:

a transmission line including a dielectric substrate, a main conductor, and an earth conductor, both the main conductor and the earth conductor being formed on the dielectric substrate;

a hollow TE011 mode resonator disposed in proximity to the main conductor of the transmission line and electromagnetically coupled to the transmission line;

at least one electrodeless portion formed in a part of the main conductor of the transmission line, the part being coupled to the resonator, and input/output connectors for connecting the resonance device to an external circuit;

wherein said resonator is partly cut away to avoid contact with said main conductor.

21. A duplexer comprising:

at least two filters;

input/output connectors connected respectively to first ends of the filters; and an antenna connector connected in common to second ends of the filters;

wherein at least one of the filters comprises a resonance device comprising:

a transmission line including a dielectric substrate, a main conductor, and an earth conductor, both the main conductor and the earth conductor being formed on the dielectric substrate;

a hollow TE011 mode resonator disposed in proximity to the main conductor of the transmission line and electromagnetically coupled to the transmission line;

at least one electrodeless portion formed in a part of the main conductor of the transmission line, the part being coupled to the resonator, and input/output connectors for connecting the resonance device to an external circuit;

wherein said resonator is partly cut away to avoid contact with said main conductor.

22. A communication device comprising:

at least one of a transmission circuit and a reception circuit;

wherein one ofthe transmission circuit and the reception circuit includes an oscillator, the oscillator comprising:

a resonance device comprising:

a transmission line including a dielectric substrate, a main conductor, and an earth conductor, both the main conductor and the earth conductor being formed on the dielectric substrate;

a hollow TE011 mode resonator disposed in proximity to the main conductor of the transmission line and electromagnetically coupled to the transmission line;

at least one electrodeless portion formed in a part of the main conductor of the transmission line, the part being coupled to the resonator;

a casing containing the resonance device; and a printed circuit board;

wherein said resonator is partly cut away to avoid contact with said main conductor.

23. A communication device comprising:

a duplexer comprising:

at least two filters;

input/output connectors connected respectively to first ends of the filters;

an antenna connector connected in common to second ends of the filters;

wherein at least one of the filters comprises:

a resonance device comprising:

a transmission line including a dielectric substrate, a main conductor, and an earth conductor, both the main conductor and the earth conductor being formed on the dielectric substrate;

a hollow TE011 mode resonator disposed in proximity to the main conductor of the transmission line and electromagnetically coupled to the transmission line;

at least one electrodeless portion formed in a part of the main conductor of the transmission line, the part being coupled to the resonator; and input/output connectors for connecting the resonance device to an external circuit;

a transmission circuit connected to at least one input/output connector ofthe duplexer; and a reception circuit connected to at least one input/output connection of the duplexer, which is different from the input/output connector connected to the transmission circuit;

wherein said resonator is partly cut away to avoid contact with said main conductor.

24. A communication device comprising:

at least one of a transmission circuit and a reception circuit;

wherein one of the transmission circuit and the reception circuit includes a filter, wherein the filter comprises:

a resonance device comprising:

a transmission line including a dielectric substrate, a main conductor, and an earth conductor, both the main conductor and the earth conductor being formed on the dielectric substrate;

a hollow TE011 mode resonator disposed in proximity to the main conductor of the transmission line and electromagnetically coupled to the transmission line;

at least one electrodeless portion formed in a part of the main conductor of the transmission line, the part being coupled to the resonator; and input/output connectors for connecting the resonance device to an external circuit;

wherein said resonator is partly cut away to avoid contact with said main conductor.

* * * * *